United States Patent [19]

Warner

[11] 4,033,471

[45] July 5, 1977

[54] LIFT TRUCK

[76] Inventor: D. T. Warner, 10 Waldron Drive, Oadby, Leicestershire, England

[22] Filed: June 16, 1976

[21] Appl. No.: 696,466

[52] U.S. Cl. ..... 214/671; 74/29

[51] Int. Cl.[2] ..... B66F 9/20

[58] Field of Search ..... 214/670, 671, 672, 673, 214/674, 730, 731; 298/11; 187/19; 74/29, 411

[56] References Cited

UNITED STATES PATENTS

| | | | |
|---|---|---|---|
| 256,373 | 4/1882 | Robbins | 298/11 |
| 379,693 | 3/1888 | Fitchit | 214/316 |
| 1,902,946 | 3/1933 | Breed | 187/19 |
| 3,366,260 | 1/1968 | Salna et al. | 214/671 |
| 3,907,140 | 9/1975 | Jinks | 214/671 |

*Primary Examiner*—Lawrence J. Oresky
*Attorney, Agent, or Firm*—Seidel, Gonda & Goldhammer

[57] ABSTRACT

The mast of a lift truck has upper and lower pinions cooperating with upper and lower racks respectively. The upper pinion has more teeth than the lower pinion for causing the mast to tilt and thereby compensate for the deflection effect of the load on the lifting arms.

4 Claims, 4 Drawing Figures

LIFT TRUCK

BACKGROUND

It is believed that the subject matter of the present invention is classifiable in class 214. This invention is an improvement over U.S. Pat. No. 3,907,140. The disclosure in said patent is incorporated herein by reference. The improvement of the present invention over the lift truck disclosed in said patent is primarily in the structure to counterbalance any load supported by the mast lifting arms.

BRIEF SUMMARY OF INVENTION

The lift truck includes a conventional truck body supported on wheels. A mast having vertically movable lift arms is supported at a front end of the vehicle body for transverse movement across the front end of the body. The body is provided with upper and lower racks.

An upright shaft is rotatably supported by the mast. An upper pinion is provided on said shaft in mesh with the upper rack. A lower pinion is provided on said shaft in mesh with the lower rack. The upper pinion has more teeth than the lower pinion. Hence, the mast will tilt as it moves to either side of the center line of the truck.

It is an object of the present invention to provide a simple, inexpensive and reliable means for counterbalancing a load supported by lift arms on a mast in a manner which requires little or no maintenance.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
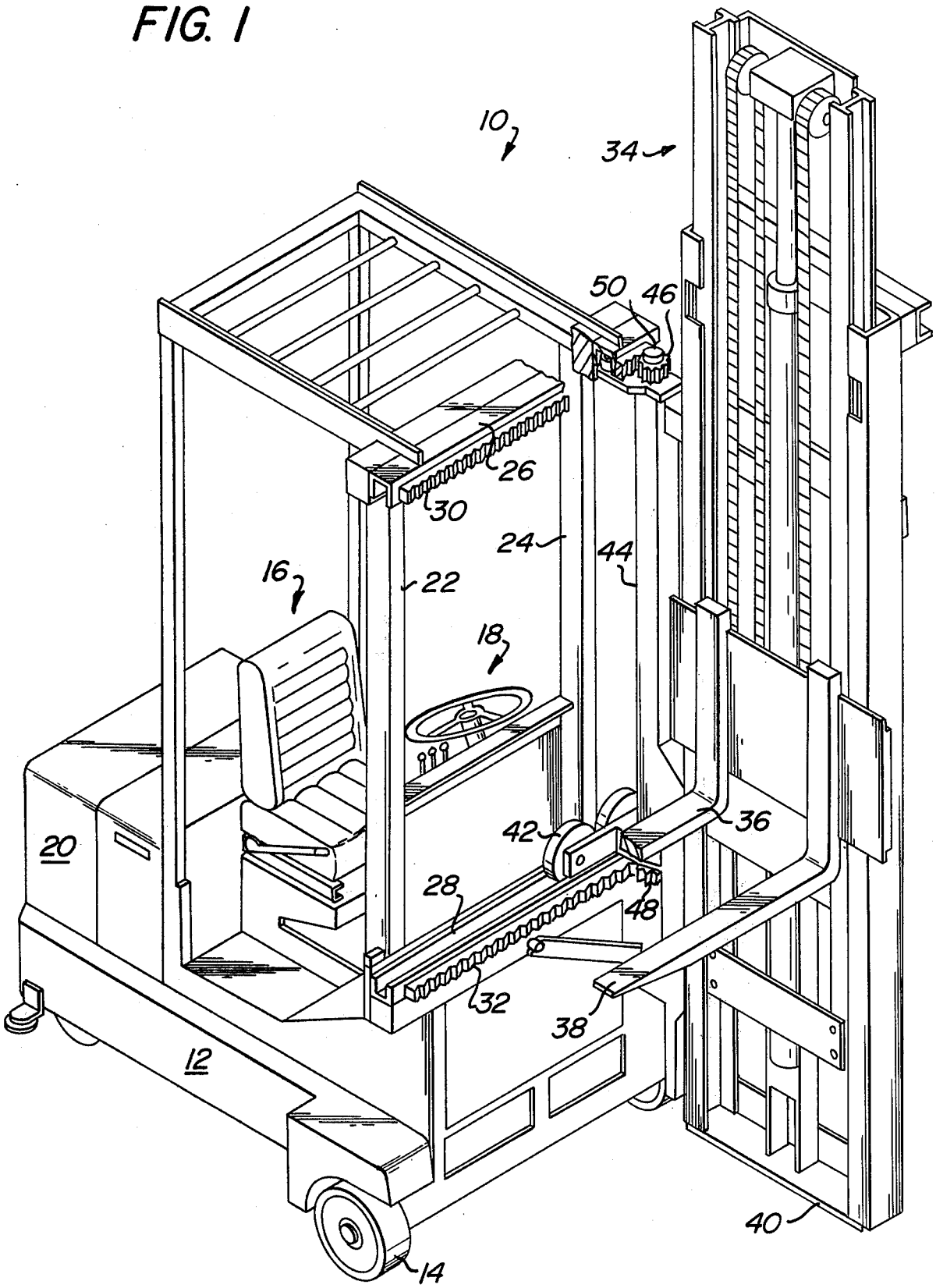
FIG. 1 is a perspective view of a lift truck in accordance with the present invention.

Referring to the drawing in detail, wherein like numerals indicate like elements, there is shown a lift truck in accordance with the present invention designated generally as 10. Lift truck 10 is the same as the lift truck in U.S. Pat. No. 3,907,140 except for the counterbalancing of the mast as will be made clear hereinafter. Since the components of the lift truck 10 of the present invention, except for the counterbalancing, are disclosed in said patent, such components will only be described briefly.

The lift truck 10 includes a body 12 mounted on wheels 14 and having an operator station 16. The operator station 16 includes a steering wheel 18 and controls associated therewith. The body 12 has a motor means, such as a battery, for propelling the lift truck 10.

The lift truck 10 is adapted for narrow aisle operation. To that end, the body 12 is provided with upright columns 22 and 24 at the front end thereof. The columns 22 and 24 are interconnected at their upper end, inter alia, by a transverse bearing channel 26 and at their lower end by a similar channel 28. An upper rack 30 is secured to the channel 26. A lower rack 32 is secured to the channel 28. Any conventional fastening means may be utilized to secure the racks to their respective channels.

A mast designated generally as 34 is supported at the front end of the body 12. Any conventional means such as the means disclosed in said U.S. patent may be utilized to cause the mast 34 to move transversely across the front end of the body 12 under the control of the operator. The mast 34 is vertically extensible and is provided with vertically movable lift arms 36 and 38. Lift arms 36 and 38 are adapted to be elevated from a position adjacent ground level to a position such as 24 feet. Conventional components, such as those disclosed in said U.S. patent, are provided on the mast 34 to effect vertical movement of the lift arms 36, 38. The frame of the mast 34 is designated as 40. Rollers 42 are supported by the frame 40 and are disposed within the channel 28 to guide the mast 34.

A vertically disposed traverse post 44 is supported by the frame 40. Post 44 is hollow and may be circular or rectangular in transverse cross section. A vertically disposed shaft 50 is rotatably supported in suitable bearings adjacent the upper and lower ends of the post 44.

A pinion 46 is secured to the upper end of shaft 50 and is in mesh with the upper rack 30. A pinion 48 is secured to the shaft 50 adjacent its lower end and is in mesh with the rack 32. The racks 30 and 32 are identical. The pinions 46 and 48 have the same diametral pitch for proper tooth engagement in the racks 30, 32. However, the upper pinion 46 has a larger number of teeth than the pinion 48. For example, pinion 46 may have 24 teeth while pinion 48 is provided with 23 teeth. If desired, the pinions could be identical but the racks changed so as to be of different pitch.

Figure 2:
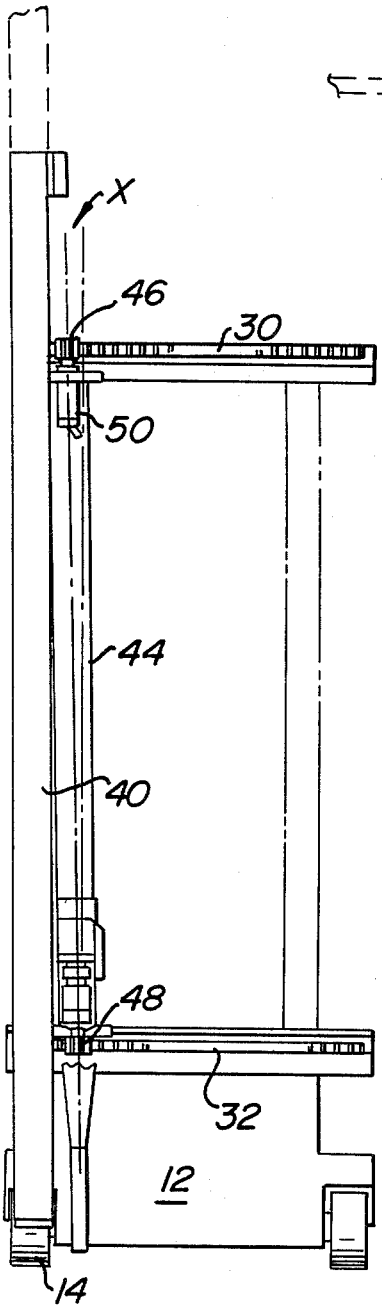
FIG. 2 is a front elevation view of the truck with the mast being in a load receiving position.
Figure 3:
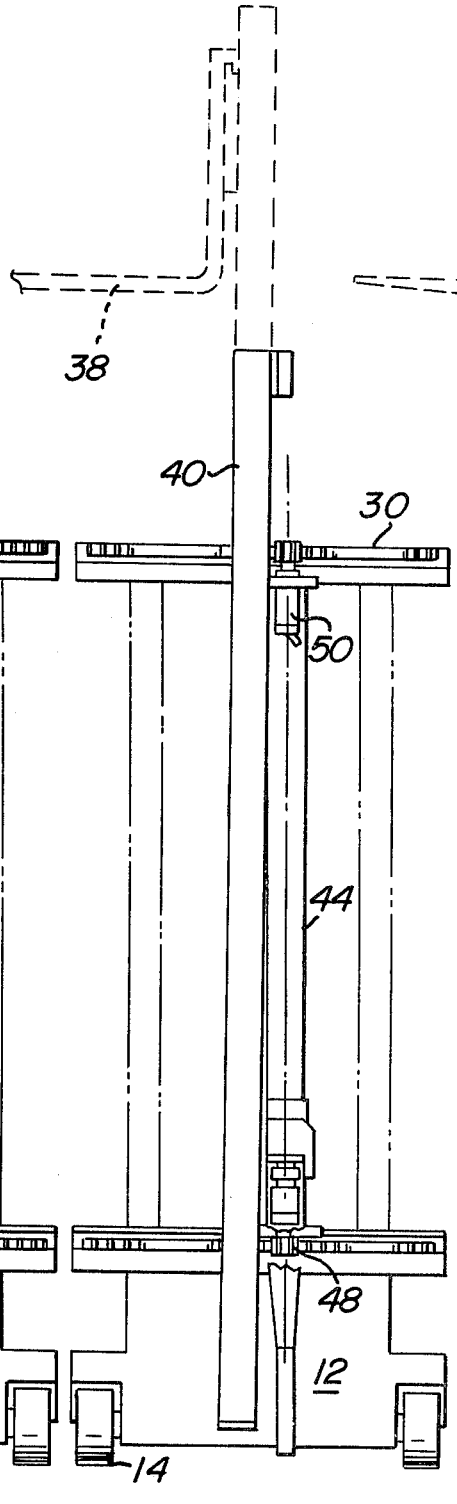
FIG. 3 is a view similar to FIG. 1 but with the mast along the center line of the truck.
Figure 4:
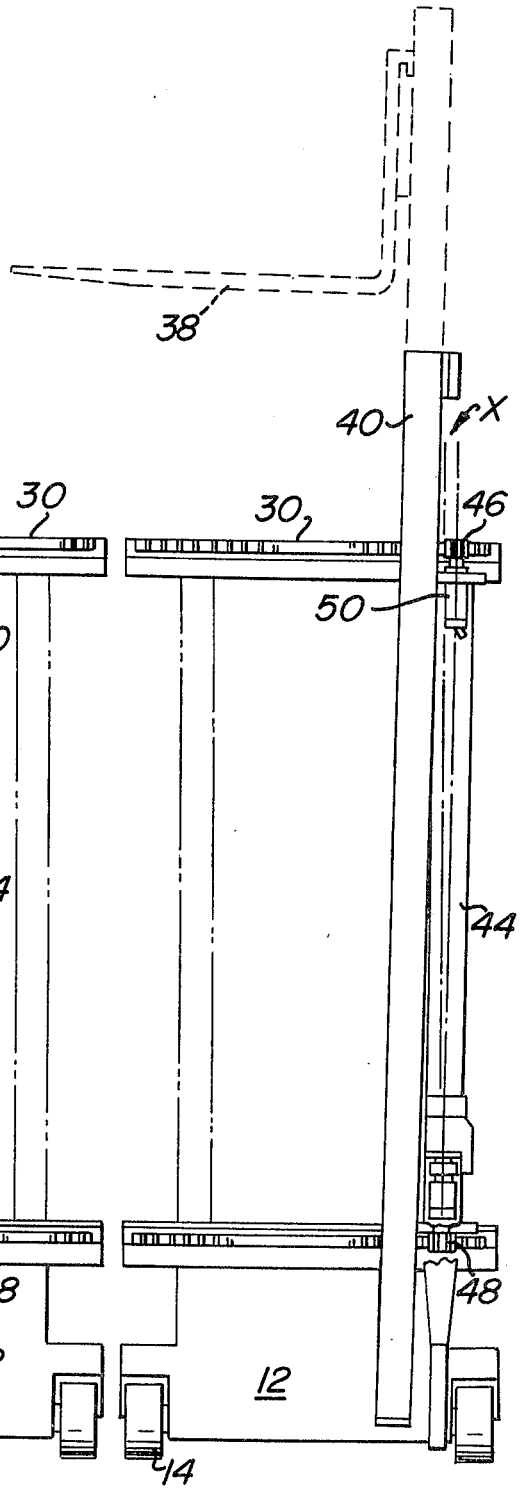
FIG. 4 is a view similar to FIGS. 2 and 3 but showing the mast in a load transporting position.

The differential in the number of teeth between the pinions 46 and 48 may be varied as desired. When the mast 34 is disposed along the center line of the body 12 as shown in FIG. 3, the mast is vertically disposed. When the mast 34 is moved to a load receiving position or load transferring position as shown in FIG. 2, the mast tilts from the vertical with the degree of tilt being indicated as X. When the mast is the load transporting position as shown in FIG. 4, the mast 34 is tilted in the opposite direction with the degree of tilt being indicated as X. The degree of tilt X is preferably in the range of 1° to 3°. The degree of tilt must be small to prevent binding of the pinions and their respective racks. Obviously with this small degree of tilt, there is enough play between the pinions and the racks to allow such tilting with or without some minor flexure of a component of the mast. With the mast 34 in a load transporting position such as that in FIG. 4, the tilt of the mast compensates for the deflection effect of the load on the lifting arms 38. The mast 34 is preferably capable of rotating 180° as described in said U.S. patent whereby the mast is in position as shown in FIG. 2 when in its load transporting position.

In view of the above disclosure, a detailed description of operation is not deemed necessary. Thus, it will be apparent to those skilled in the art that the upper pinion 46 will travel further than the lower pinion 48 as the mast 34 is traversed across the front end of the body 12 to thereby cause the mast to tilt from the vertical as the mast 34 moves in either direction from the center line of the body 12. When assembling the truck of the present invention, the shaft 50 is disposed vertically and assembled to the center line of the truck body 12.

Thus, it will be seen that there is disclosed herein a simple, inexpensive and reliable maintenance-free means for compensating for load deflection applied to a mast.

The present invention may be embodied in other specific forms without departing the spirit or essential attributes thereof and, accordingly, reference should be made to the appended claims, rather than to the foregoing specification as indicating the scope of the invention.

It is claimed:

1. A lift truck comprising a truck body supported by wheels, a mast having vertically movable lift arms thereon, said mast being supported on a front end of said body for transverse movement across said front end, upper and lower racks on said body, an upright shaft rotatably supported by said mast, an upper pinion on said shaft in mesh with said upper rack, a lower pinion on said shaft in mesh with said lower rack, said shaft interconnecting said pinions for causing said pinions to rotate through the same degree of rotation, said upper pinion having more teeth than the lower pinion, and said pinions having the same diametral pitch, whereby said post is vertically disposed when on the center line of said truck body and is tilted with respect to the vertical when disposed to one side of said truck body center line.

2. A lift truck comprising a truck body supported by wheels, a mast having a vertially movable lift arm thereon, said mast being supported on a front end of said body for transverse movement across said front end, upper and lower sets of racks and pinions associated with said mast and body for causing the upper end of said mast to move through a greater distance than the lower end of said mast when said mast is moved transversely from the center line of said truck body, an upright portion of said mast interconnecting said pinions for causing said pinions to rotate through the same degree of rotation, whereby said mast tilts with respect to the vertical when said mast is remote from the center line of said truck body.

3. A lift truck in accordance with claim 2 wherein the maximum angular tilt with respect to the vertical is 3°.

4. A lift truck in accordance with claim 2 wherein said rack and pinion means includes an upright shaft on said mast, an upper pinion connected to the upper end of said shaft and meshing with the upper rack, a lower pinion on said shaft and meshing with a lower rack, said upper pinion having more teeth than said lower pinion, said racks being identical, and said pinions having the same diametral pitch.

* * * * *